US005580004A

United States Patent [19]

Tamura et al.

[11] Patent Number: 5,580,004

[45] Date of Patent: Dec. 3, 1996

[54] SELF-PROPELLED CRUSHING MACHINE

[75] Inventors: Yukio Tamura; Satoru Koyanagi; Yasutaka Nishida; Toru Nakayama; Masaho Yamaguchi, all of Kanagawa, Japan

[73] Assignee: Kabushiki Kaisha Komatsu Seisakusho, Tokyo, Japan

[21] Appl. No.: 501,078

[22] PCT Filed: Feb. 24, 1994

[86] PCT No.: PCT/JP94/00298

§ 371 Date: Aug. 4, 1995

§ 102(e) Date: Aug. 4, 1995

[87] PCT Pub. No.: WO94/19107

PCT Pub. Date: Sep. 1, 1994

[30] Foreign Application Priority Data

Feb. 26, 1993 [JP] Japan ..... 5-007513
Feb. 26, 1993 [JP] Japan ..... 5-38229

[51] Int. Cl.[6] ..... B02C 1/00; B02C 21/02

[52] U.S. Cl. ..... 241/36; 241/101.74; 241/262

[58] Field of Search ..... 241/101.74, 263, 241/262, 36

[56] References Cited

U.S. PATENT DOCUMENTS

| | | | |
|---|---|---|---|
| 4,073,445 | 2/1978 | Clonch . | |
| 4,580,732 | 4/1986 | Mantell | 241/30 |
| 4,765,546 | 8/1988 | Stewart | 241/36 |
| 4,961,542 | 10/1990 | Den Besten et al. . | |
| 4,997,135 | 3/1991 | Zehr . | |
| 5,082,187 | 1/1992 | Kirchhoff et al. | 241/84 |
| 5,161,744 | 11/1992 | Schoop et al. . | |
| 5,460,332 | 10/1995 | Frick | 241/101.74 |

FOREIGN PATENT DOCUMENTS

| | | |
|---|---|---|
| 60-139347 | 7/1985 | Japan . |
| 62-40687 | 10/1987 | Japan . |
| 63-77553 | 4/1988 | Japan . |
| 64-32744 | 3/1989 | Japan . |
| 3-130859 | 12/1991 | Japan . |

*Primary Examiner*—John M. Husar
*Attorney, Agent, or Firm*—Frishauf, Holtz, Goodman, Langer & Chick

[57] ABSTRACT

When objects of crushing are clogged between a bottom plate and a crusher, a locking of the bottom plate that may ensue is automatically released in a self-propelled crushing machine. The machine comprises a feeder hydraulic motor (54) for reciprocating the bottom plate of a hopper and a feeder valve (50) for supplying a first port (54*a*) and a second port (54*b*) of the feeder hydraulic motor (54) with a pressurized discharged fluid from a hydraulic pump. The feeder valve (50) takes a first position (B) upon a first solenoid (55) thereof being electrically energized and takes a second position (C) upon a second solenoid (56) thereof being electrically energized. a keep relay (59) electrically energizes the first solenoid (55) and the second solenoid (56) by passing an electric current through each of them, and a first pressure switch (57) and a second pressure switch (58) are turned on when a pressure of the first port (54*a*) and a pressure of the second port (54*b*) exceeds a set pressure, respectively. The first pressure switch (57) and the second pressure switch (58) and the keep relay (59) are connected so that when the first pressure switch (57) or the second pressure switch 58) is turned on, an electric current can be passed through the first solenoid (55) or the second solenoid (56).

18 Claims, 10 Drawing Sheets

SELF-PROPELLED CRUSHING MACHINE

TECHNICAL FIELD

The present invention relates to a self-propelled crushing machine for crushing an object of crushing such as a concrete waste or the like at a site of taking down a building or the like. More particularly, the invention is concerned with a self-propelled crushing machine that is equipped with a mechanism for controlling the amount of objects of crushing which is fed to a crusher. Further, this invention is related to a self-propelled crushing machine that is equipped with a mechanism for controlling the amount of objects of crushing that is supplied to a hopper which is designed to feed them into a crusher.

BACKGROUND ART

As a conventional self-propelled crushing machine, there has been known, as disclosed in Japanese Unexamined Utility Model Publication No. Sho 64-32744 and Japanese Unexamined Patent Publication No. Sho 63-77553, a machine in which a hopper, a crusher and a drive means are mounted on a vehicular chassis that is provided with a pair of left hand side and right hand side traveling bodies and in which a discharge conveyer 16 is provided so as to be capable of being raised up and lowered down between the left hand side and right hand side traveling bodies at a lower portion of the above mentioned vehicular chassis.

Such a self-propelled crushing machine can travel by itself by rotationally driving a crawler or wheels and can finely crush an object of crush such as concrete waste and so forth that are charged via a feeder into the hopper. It can further discharge the crushed pieces out of the vehicular chassis through the conveyor.

In a self-propelled crushing machine as disclosed in Japanese Unexamined Utility Model Publication No. Sho 64-32744, an object of crushing that is charged into a hopper is dropped by the hopper directly into a crusher. Since the object of crushing is then caused to fall by its own weight along the hopper, the amount thereof that is fed into the crusher is varied depending upon its own weight as well as the amount that is charged into the hopper, and sometimes it cannot be crushed with stability. In addition, the object of crushing may possibly be clogged within the hopper, making it impossible for it to be fed into the crusher.

Also, as disclosed in Japanese Unexamined Patent Publication No. Sho 60-139347, a feeder has been known for supplying an object of crushing into a crusher. More specifically, a feeder has been known in which a comb-like plate that is reciprocated obliquely up and down is used to conduct a screening of the sizes of objects of conveyance that are charged into a hopper and to feed them into a crusher.

While such a feeder is capable of screening the sizes of objects of conveyance, it is unable to control their amounts of feed. It has also been found to be undesirable in that the feeder may be supplying an amount that exceeds the ability for a crusher to crush, thus either bringing about a reduced efficiency of crushing by the crusher or acting to apply an unreasonable force to the crusher.

SUMMARY OF THE INVENTION

Accordingly, it is a primary object of the present invention to provide a self-propelled crushing machine which is capable of effectively eliminating the locking of a bottom plate that is due to the clogging of an object of crushing in the process of controlling its amount to be fed into a crusher.

In order to attain the foregoing object, there is provided in accordance with the present invention, in a first construction thereof, a self-propelled crushing machine, in which a crusher and a hopper are mounted on a vehicular chassis that is provided with a pair of left hand side and right hand side traveling bodies and in which a discharge conveyer is arranged between the left hand side and right hand side traveling bodies of said vehicular chassis, wherein a bottom plate which is formed in said hopper is capable of being displaced towards a charge inlet of the said crusher; said bottom plate of the hopper and a rotary disk which is adapted to be rotationally driven are connected by a connecting rod so as to reciprocate said bottom plate by way of a rotation of said disk; a feeder hydraulic motor for rotating said disk has a first port and a second port which are supplied with a discharged fluid from a hydraulic pump by means of a feeder valve; and the said feeder valve is capable of being switched between a first position for supplying a pressurized fluid into said first port and a second position for supplying the pressurized fluid into said second port, and is capable of being switched from said first position to said second position or vice versa when a pressure of said first port or a pressure of the said second port exceeds a set pressure, respectively.

Preferably, said feeder valve is adapted to take said first position upon a first solenoid thereof being supplied with an electric current and to take said second position upon a second solcnoid thereof being supplied with an electric current, and it is preferred that there be provided a keep relay for passing an electric current through said first solenoid and said second solenoid, and a first pressure switch and a second pressure switch which are adapted to be turned on when said set pressure is exceeded by the pressures of said first port and said second port, respectively, and that said first pressure switch and said second pressure switch and said keep relay are connected so that when said first pressure switch or said second pressure switch is turned on, an electric current can be passed through said first solenoid or said second solenoid It is desirable that the above mentioned rotary disk and the above mentioned connecting rod be connected together at a radially variable position of the above mentioned rotary disk to enable the above mentioned bottom plate to be reciprocated with a variable stroke amplitude of the reciprocation. Further, at a rear end portion of the above mentioned bottom plate in a direction of feeding said objects of crush, there should preferably be provided with a portion of protrusion that is formed to project from an upper surface of said bottom plate.

The present invention also provides, in a second construction thereof, a self-propelled crushing machine wherein a vehicular chassis which is provided with a traveling apparatus and is capable of being self-propelled comprises: a crusher which is mounted on said vehicular chassis for crushing objects a hopper which is disposed above said crusher for charging the objects of crushing into said crusher; a charge inlet which is interposed between said crusher and said hopper so as to be capable of reciprocation for a passage of the objects of crushing between said hopper and said crusher for charging the objects of crushing which are fed from the said hopper, successively into said crusher; a drive means for drivingly reciprocating the said charge inlet; and a drive control device which is responsive to a locking state during the reciprocation of said charge inlet for automatically switching an operating mode of said drive control device from a mode for charging the objects of crushing to a mode for releasing said locking state.

In the construction mentioned above, it is preferable that the above mentioned drive control device in the mode for releasing the above mentioned locking state be responsive to a release of said locking state for automatically restoring the drive control device operating mode to said mode for charging the objects of crushing from said mode for releasing the locking state.

The above mentioned drive control device may comprise a hydraulic motor that is provided with a first and a second fluid supply port so as to be driven in a regular direction of rotation upon said first fluid supply port being supplied with a pressurized fluid from a source thereof to operate in said mode for charging the objects of crushing and to be driven in a reverse direction of rotation upon said second fluid supply port being supplied with the pressurized fluid from said source thereof to operate in said mode for releasing the locking state. Also, the above mentioned drive control device may include a pressure detector which is arranged in a fluid supply passage between said source of the pressurized fluid and said first fluid supply port so that when a fluid pressure detected by said pressure detector exceeds a predetermined pressure, a switching in fluid supply can be effected from said first fluid supply port to said second fluid supply port to switch the operating mode of the above mentioned drive control device from said mode for charging the objects of crushing to said mode for releasing the above mentioned locking. At this point, it should be noted that the above mentioned drive control device may be provided with a link for transforming a rotary driving force of said hydraulic motor to a linear movement force that can be transmitted to the above mentioned bottom plate. In this case, said link can comprise a rotary member which may be rotationally driven by said hydraulic motor, and a link member having a first end thereof that may be connected to a position which is offset by a predetermined distance from a center of rotation of the said rotary member and a second end thereof that may be connected to one end of the above mentioned bottom plate in a direction of the reciprocation.

Also, the amount of offset of a point of connection between the above mentioned link member and the above mentioned rotary member relative to the above mentioned center of rotation may be made variable in order to make the stroke amplitude of reciprocation of the above mentioned bottom plate variable.

Further, the above mentioned bottom plate can be constructed to be provided with a portion of stepped projection at a rear end thereof in a direction in which the objects of crush are conveyed.

At this point, it should be noted that a self-propelled crushing machine according to the present invention should preferably be provided with a discharge conveyer that is capable of being raised up and lowered down.

The present invention further provides, in a third construction thereof, a self-propelled crushing machine in which an operating seat, a hopper, a crusher connected to the hopper and a power supply therefor are mounted on a vehicular chassis that is provided with a traveling apparatus, wherein said crusher is disposed at an intermediary position between a front end and a rear end of said vehicular chassis; said hopper and said power supply are disposed at a front end and at a rear end of the said crusher, respectively; said operating seat and a motor for said crusher are disposed at a first side and at a second side of said crusher, respectively; said hopper has a bottom plate which is arranged to be capable of being displaced towards a charge inlet of said crusher; said bottom plate of the hopper and a rotary disk which is adapted to be rotationally driven are connected by a connecting rod so that a rotation of said disk may cause a reciprocation of said bottom plate; a feeder hydraulic motor for rotating said disk has a first port and a second port which are adapted to be supplied with a discharged fluid via a feeder valve from a hydraulic pump; and said feeder valve is capable of being switched between a first position for supplying a pressurized fluid into said first port and a second position for supplying a pressurized fluid into said port and is adapted to be switched from said first position to said second position or vice versa when a pressure of said first port or a pressure of the said second port exceeds a set pressure, respectively.

BRIEF EXPLANATION OF THE DRAWINGS

The present invention will better be understood from the following detailed description and the drawings attached hereto showing certain illustrative embodiments of the present invention. In this connection, it should be noted that such embodiments as illustrated in the accompanying drawings are intended in no way to limit the present invention, but to facilitate an explanation and understanding thereof.

In the accompanying drawings.

DETAILED DESCRIPTION

Hereinafter, suitable embodiments of the present invention for a self-propelled crushing machine will be set out with respect to a variety of constructions thereof with reference to the accompanying drawings. It should be noted that the contents of disclosure made in PCT/JP93/01312 filed Sep. 14, 1994 and PCT/JP93/01313 filed Sep. 14, 1994, both owned by the same assignee as the present application, are incorporated herein by reference as parts of the specification hereof.

Figure 1:
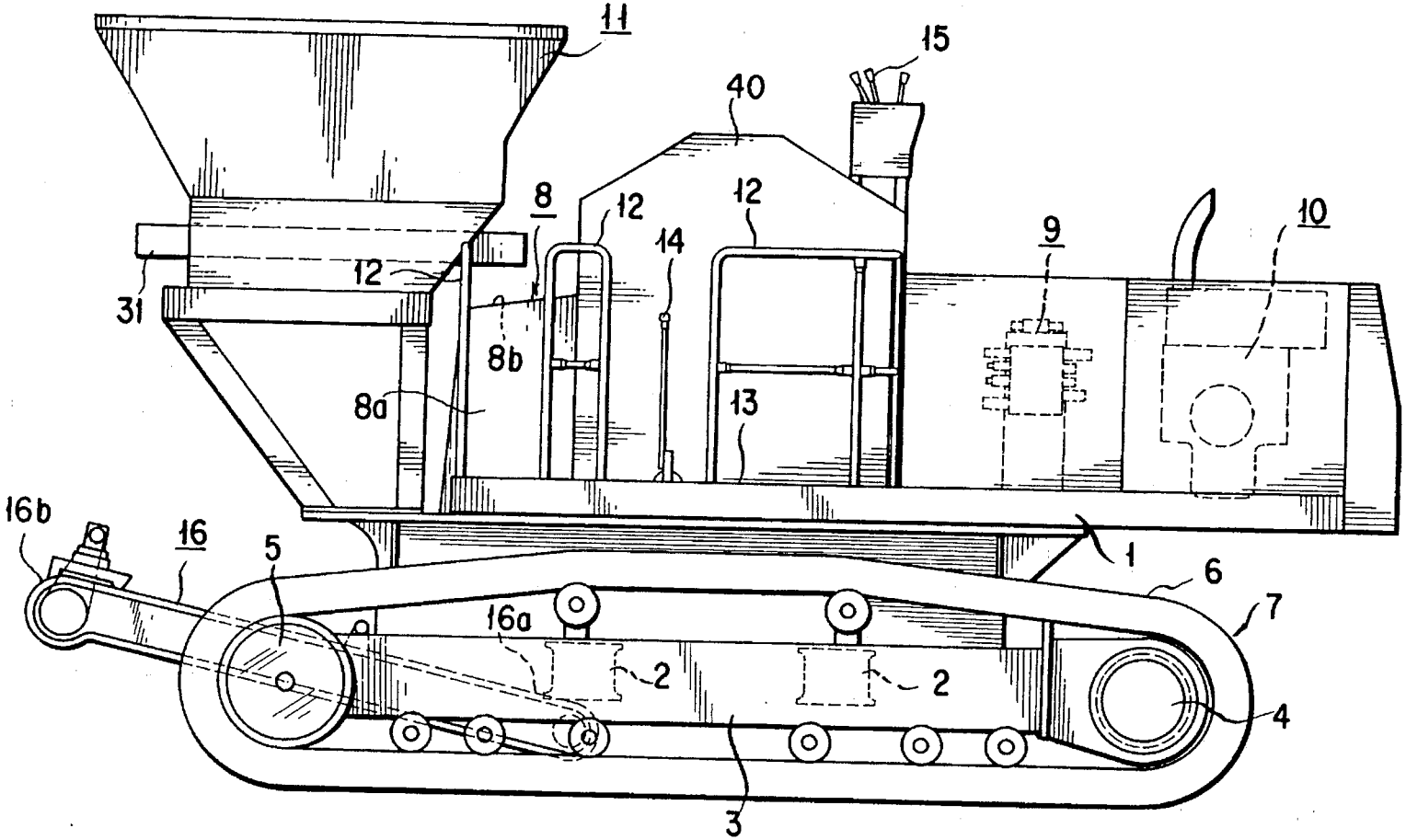
FIG. 1 is an entire side elevational view illustrating a self-propelled crushing machine which embodies, in a suitable manner, the present invention.
Figure 2:
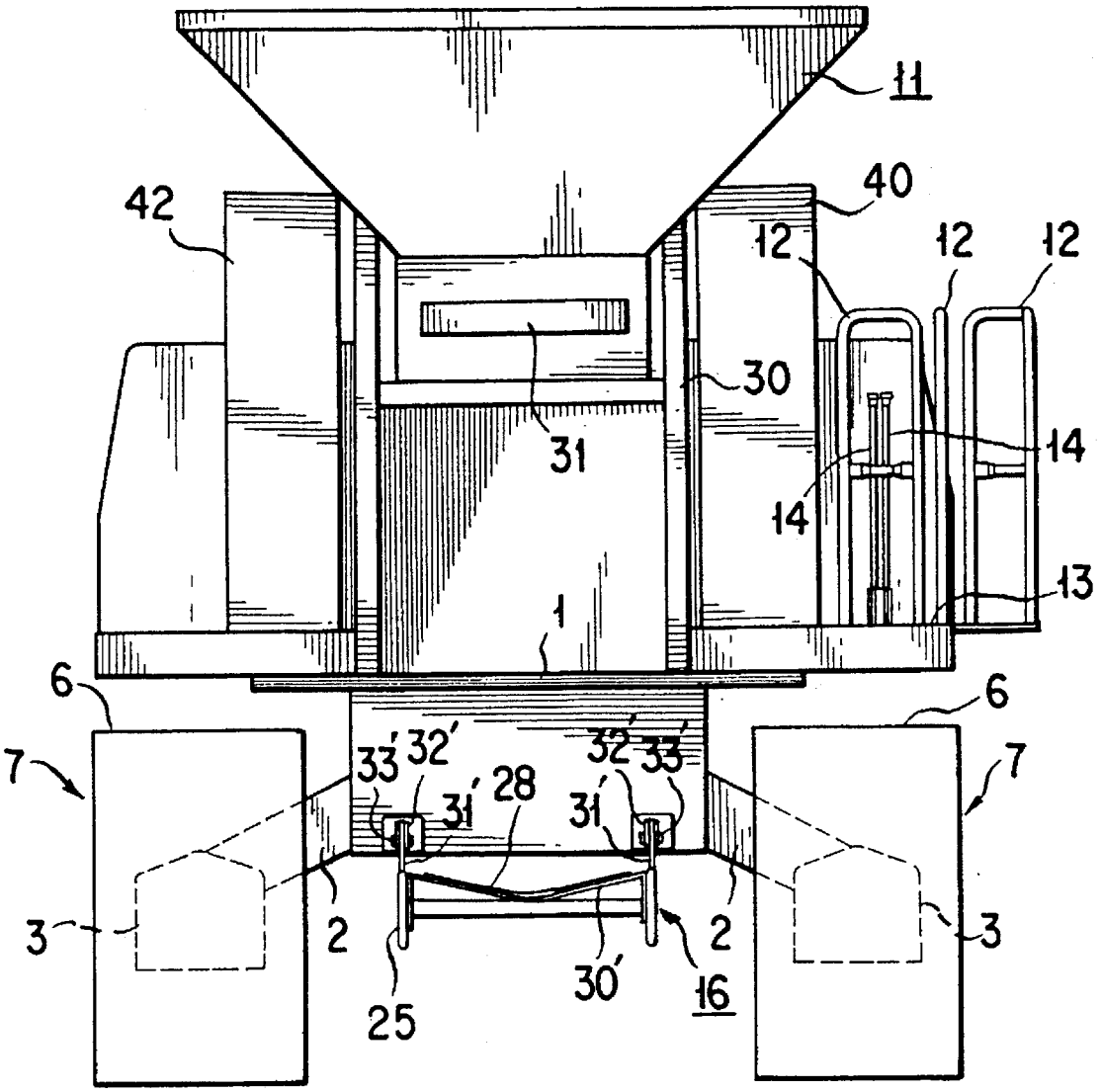
FIG. 2 is a front elevational view illustrating said self-propelled crushing machine according to the suitable embodiment of the present invention.

As shown in FIGS. 1 and 2, at both its left hand side and right hand side a vehicular chassis 1 has secured thereto a pair of left hand side truck frame 3 and right hand side truck frame 3 via a pair of cross members 2 and 2, respectively. Each of these truck frames 3 and 3 is provided with a hydraulic motor 17, and a sprocket 4 and an idler 5 which are driven by the hydraulic motor. Over the sprocket 4 and the idler 5 there is wound a crawler 6 to form a crawler type traveling mechanism 7. And, a pair of left hand side traveling mechanism 7 and right hand traveling mechanism 7 constitutes a traveling apparatus. While in the embodiment shown the crawler type traveling apparatus including mechanism 7 is employed, it should be noted that the same may be replaced by a wheel type traveling apparatus.

On the above mentioned vehicular chassis 1, there are included a hopper 11, a hydraulically driven crusher 8 and a hydraulic system that is provided with a group of valves 9. Furthermore, the vehicular chassis 1 has mounted thereon an engine 10 which serves as a drive source for the hydraulic system. In the vehicular chassis 1, a portion that protrudes from one side surface 8*a* of the crusher 8 into one of its left hand and right hand sides constitutes an operator's boarding floor 13 that is provided with a grab rail 12. The operator boarding floor 13 is provided with a pair of left hand side and right hand side traveling levers 14 and 14. Above a cover 40 disposed at the same side as the operator boarding floor 13, there are provided operating levers 15 for controlling the hopper 11 and the crusher 8 by operating the above mentioned group of valves 9.

Between the above mentioned left hand side and right hand side traveling mechanisms 7 and 7 there is disposed a discharge conveyer 16, which is capable of being rocked up and down and of which a convey-in side 16*a* is located downwards of a discharge outlet of the crusher 8 and a convey-out side 16*b* is formed to project forward from the traveling mechanisms 7 and the vehicular chassis 1.

Next, the details of each part hereinbefore described will be set out.

Figure 5:
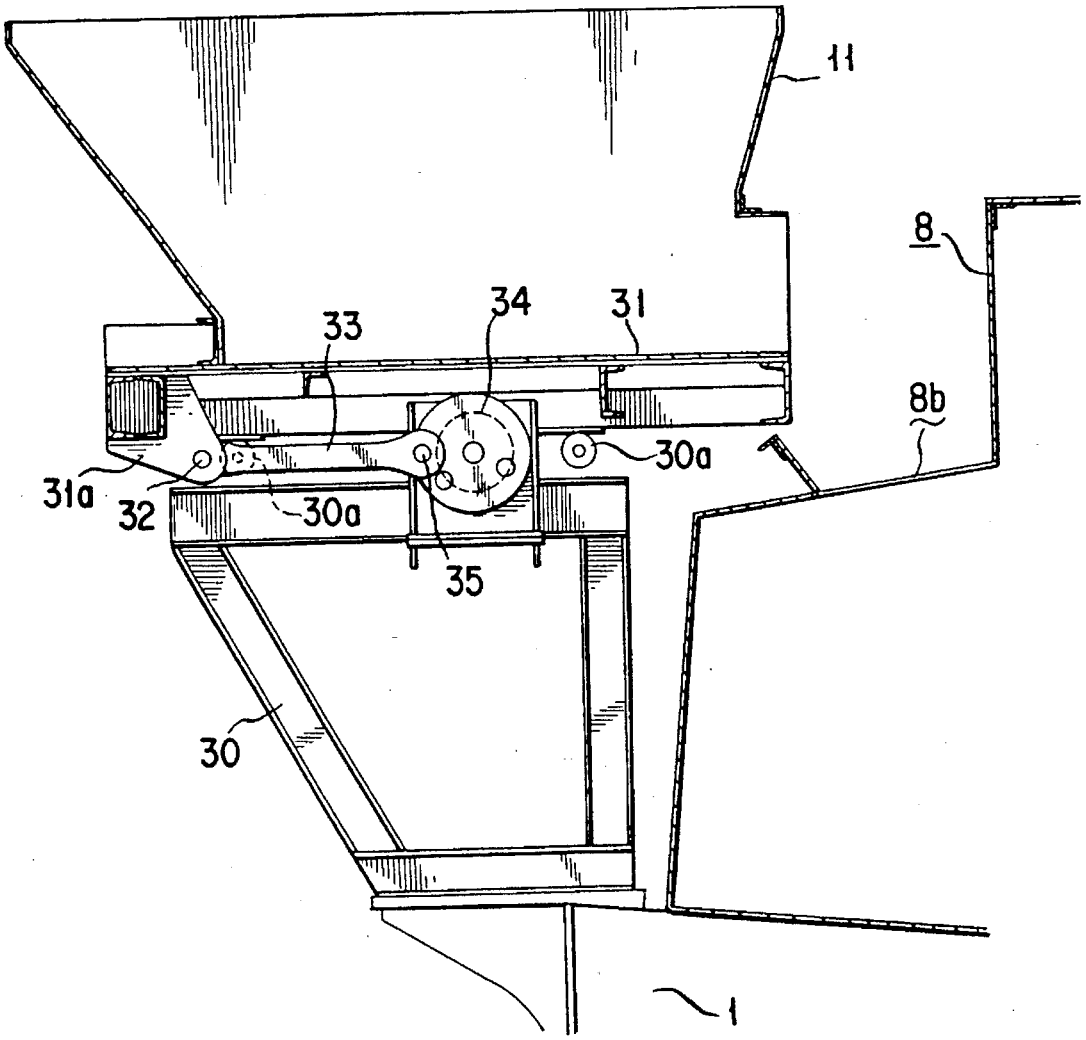
FIG. 5 is a detailed cross sectional view illustrating a portion of the machine that constitutes a hopper.
Figure 8:
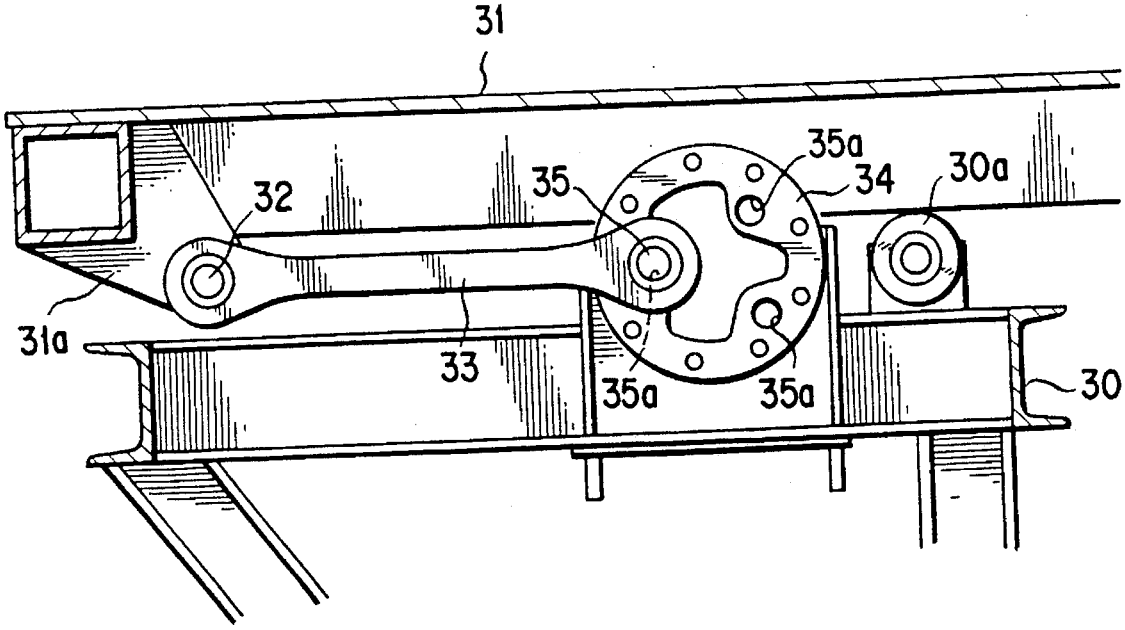
FIG. 8 is an enlarged view illustrating the essential portions of a feeder that is employed in the suitable embodiment of the present invention.
Figure 9:
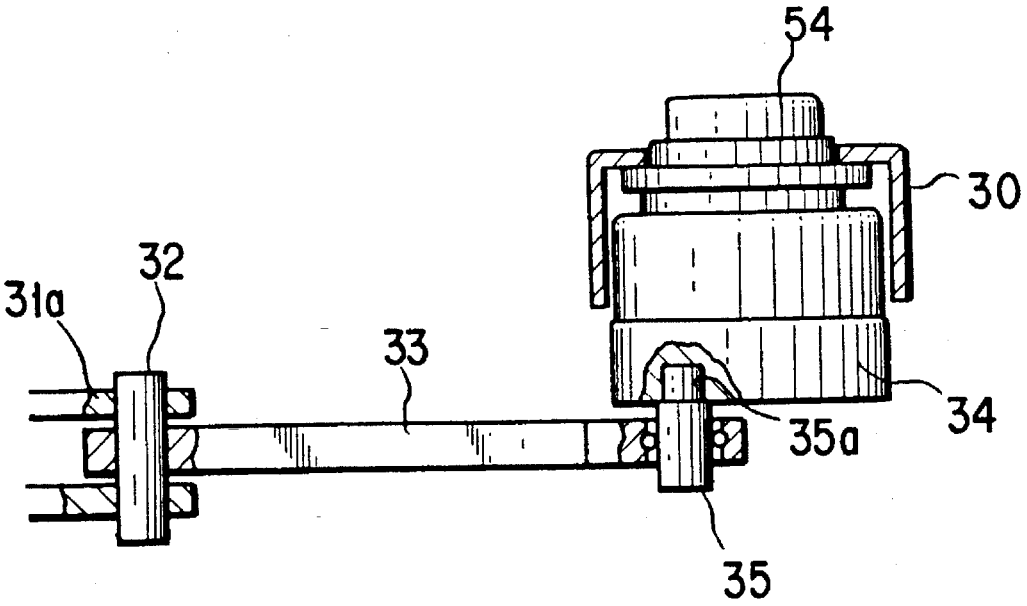
FIG. 9 is a plan view, partly broken away, illustrating a portion of the feeder shown in FIG. 8.
Figure 10:
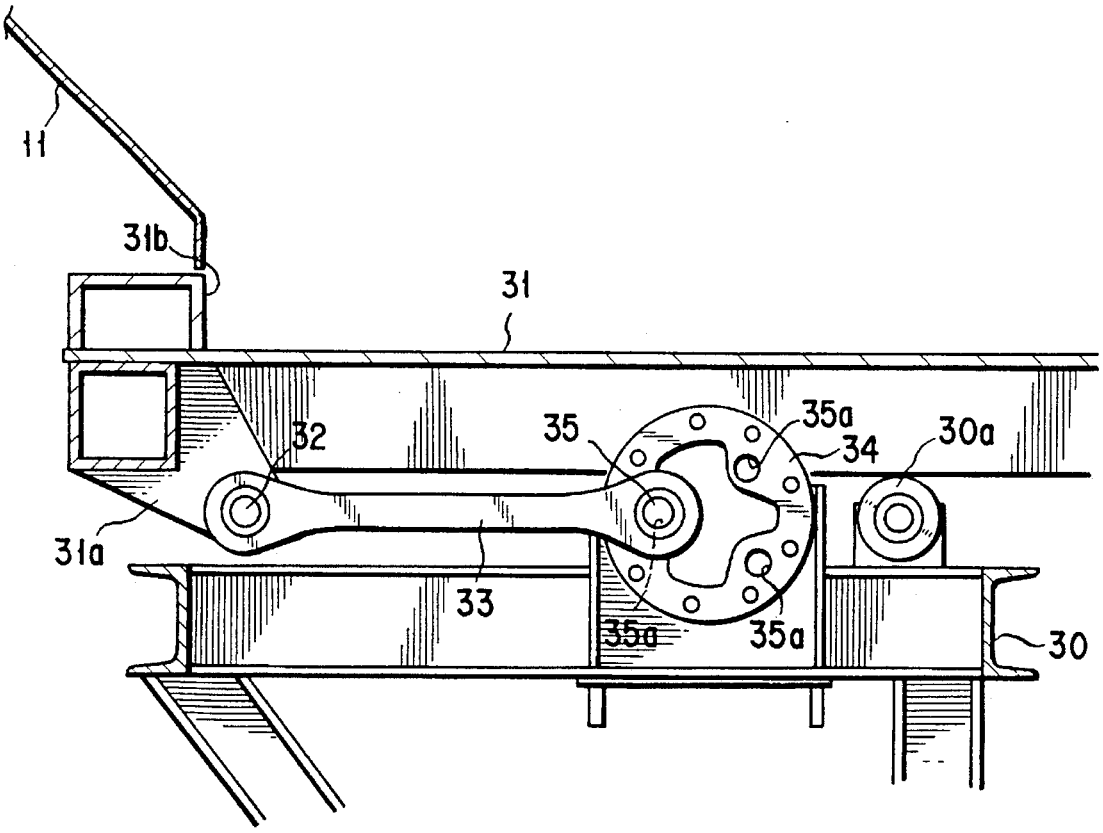
FIG. 10 is front view illustrating a feed plate which is embodied in another way.

As shown in FIG. 5, the above mentioned hopper 11 is supported by a pedestal 30 which is in turn mounted on the vehicular chassis 1. A bottom plate 31 formed in the hopper 11 is supported by guide rollers 30*a* that are in turn supported on the pedestal 30. The bottom plate 31 is arranged as capable of being reciprocated horizontally relative to a charge inlet 8*b* of the crusher 8. Also, at the end of the bottom plate 31 which is remote from the charge inlet 8*b* there is provided a bracket 31*a* that projects downwards. The bracket 31*a* is coupled by a pin 32 passing therethrough to one end of a connecting rod 33. The other end of the connecting rod 33 is coupled by a pin 35 to a rotary disk 34 at a position which is located eccentrically from a center of rotation thereof. The rotary disk 34 is rotationally driven by a hydraulic motor 36. Here, as shown in FIGS. 8 and 9, the rotary disk 34 is formed with a plurality of embedment holes 35*a* for the pin 35, whose respective radially oriented positions, i.e. their respective amounts of offset from its center of rotation, are varied, to enable the stroke amplitude of reciprocation of the bottom plate 31 in its horizontal direction to be varied. Also, as shown in FIG. 10, the bottom plate 31 can be provided thereon with a stepped portion 31*b* at a rear end thereof in a feed direction therefor so that the objects of crushing to be conveyed may be displaced towards their supply side by thrusting them with the portion 31*b* in that direction. In this construction, it is ensured that the objects of conveyance can be transported smoothly without fall, thus without causing any slip thereof on the upper surface of the bottom plate 31.

In a construction as shown, as the rotary disk 34 is rotated, the bottom plate 31 will be driven via the connecting rod 33 to be guided over the guide rollers 30*a* and will then be reciprocated with a stroke amplitude which is determined by an amount of offset of a position of connection between the rotary disk 34 and the connecting rod 33 relative to the center of rotation of the rotary disk 34. With the bottom plate 31 being reciprocated, an inertia force will act on the objects of crushing thereon and, because of the inertia force and the weight of the succeeding objects of crushing all of the objects of crushing will be oscillatorily displaced in the direction of feed and finally be cast into the charge inlet 8*b* of the crusher 8.

Figure 3:
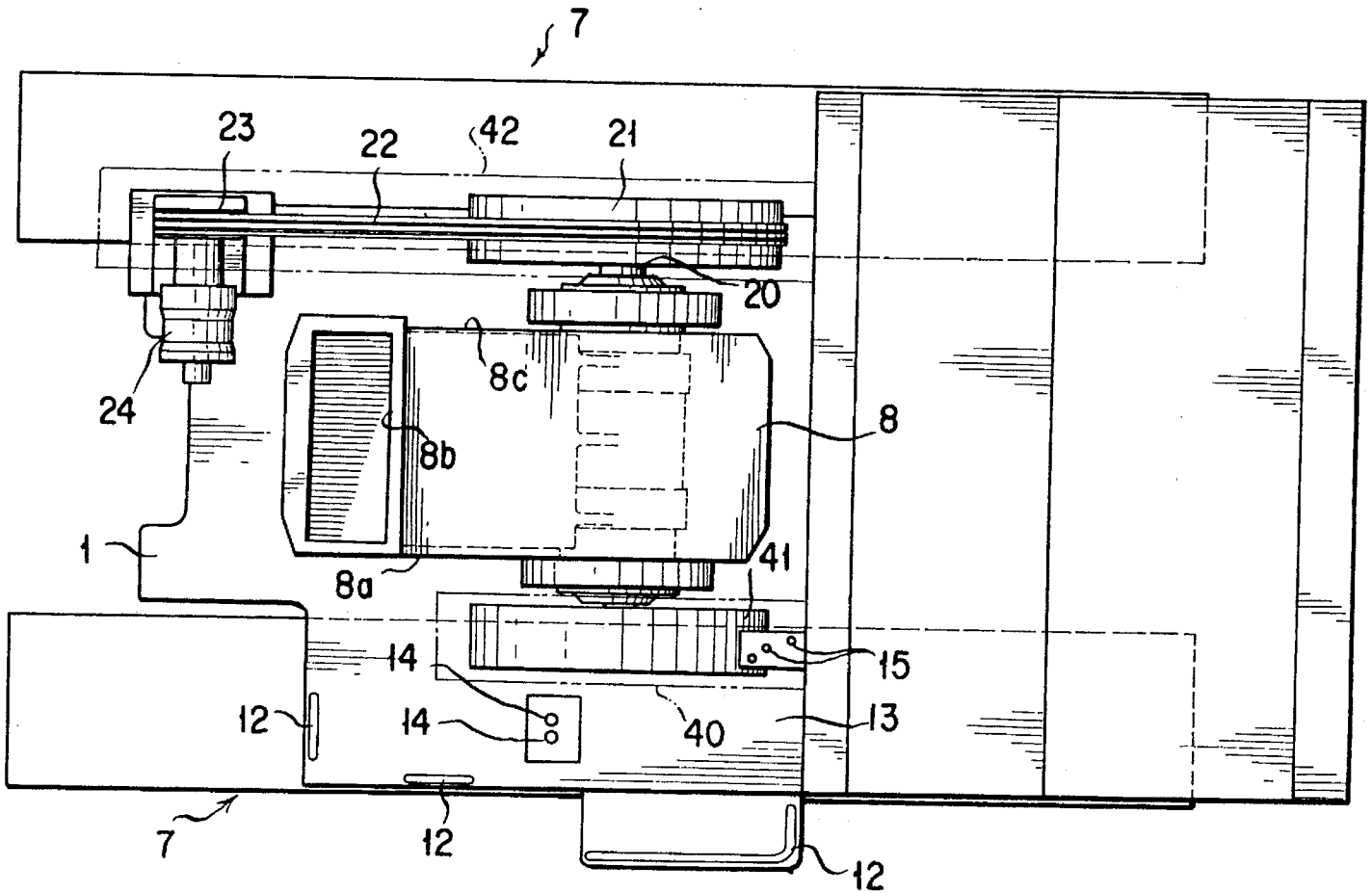
FIG. 3 is a plan view illustrating said self-propelled crushing machine according to the suitable embodiment of the present invention.

A driving shaft 20 of the above mentioned crusher 8 has, as shown in FIG. 3, its one end which is provided with a fly wheel 41 projecting from the one side surface 8*a*, whereas its other end portion is formed to project from the other side surface 8*c* so as to be driven by a hydraulic motor 24 via a pulley 21, a belt 22 and a pulley 23. Also, the above mentioned fly wheel 41 is enclosed with the one side cover 40, whereas the pulley 21, the belt 22 and the pulley 23 are enclosed with the other side cover 42.

Figure 4:
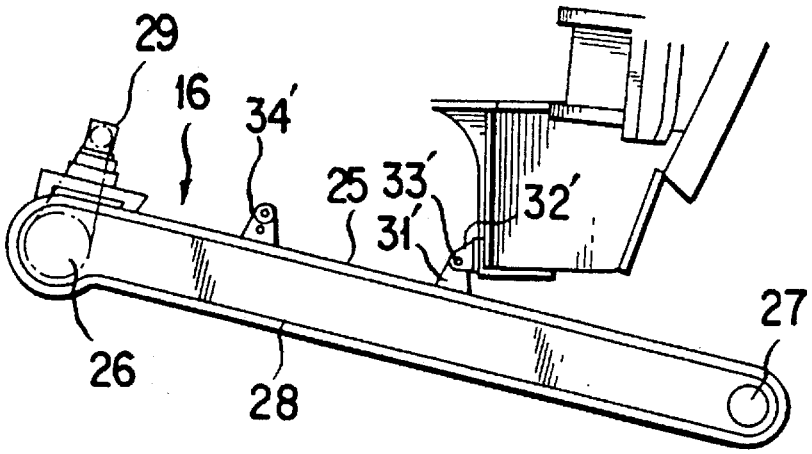
FIG. 4 is a detailed side view illustrating a portion of the machine that constitutes a discharge conveyer.

As shown in FIGS. 2 and 4, the above mentioned discharge conveyer 16 has a frame 25 that is provided with a driving pulley 26 and a driven pulley 27, over which a belt 28 is wound. The driving pulley 26 is driven by a conveyer hydraulic motor 29 to drive the belt 28. Also, the above mentioned frame 25 is provided with a V-shaped bell guide 30' in which the belt 28 is V-shaped. Also, a supporting piece 31' fixed to the frame 25 is supported onto a bracket 32' secured to the vehicular chassis 1 as capable of being rocked up and down by means of a pin 33'. The vehicular chassis 1 and a receiving piece 34' which is secured to the above mentioned frame 25 are coupled together via a number of connecting members such as a turnbuckle, rods and wires. By varying the length of a coupling member in this connection, the conveyer 16 is capable of being raised up and lowered down between a posture of being upwardly inclined and a posture of being oriented horizontally.

With the present embodiment being constructed as mentioned in the foregoing, when objects of crushing are loaded into the hopper 11, the bottom plate upon once receiving the objects of crushing thereon will be reciprocated to cause them to be fed, by dropping, into the crusher 8 through the charge inlet 8*b* thereof. As a consequence, if the weight of of the objects of crushing and their loaded amount in the hopper 11 are varied, it is possible for the objects of crushing to be charged into the crusher 8 in a substantially identical amount per unit time. It follows, therefore, that the object of crushing will be crushed stably by the crusher 8 and that they may not be clogged within the hopper 11.

An explanation will now be given of a hydraulic circuit for those hydraulic motors mentioned previously.

Figure 6:
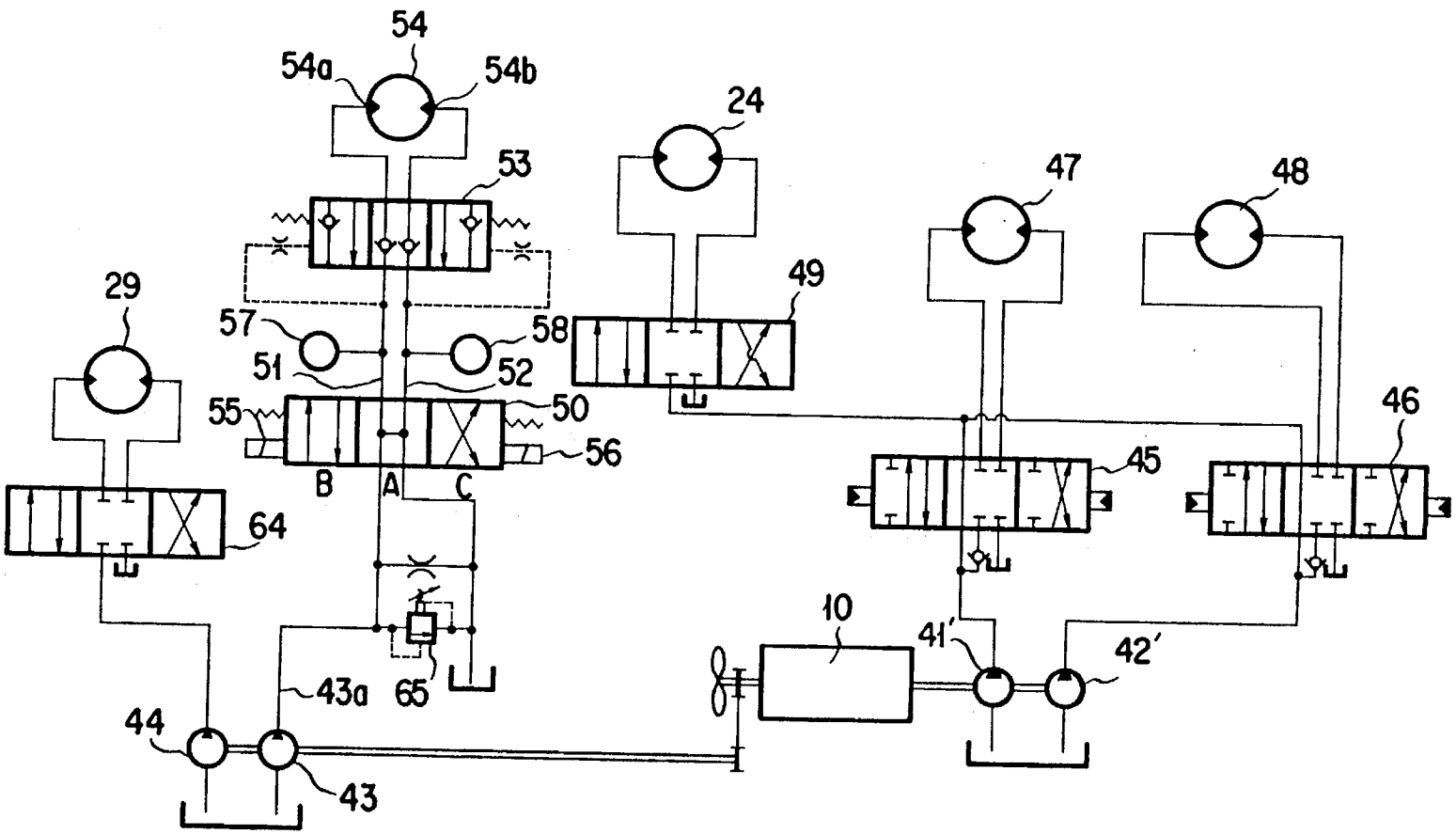
FIG. 6 is a hydraulic circuit diagram illustrating a hydraulic system that is adopted for driving a bottom plate formed in the hopper in said self-propelled crushing apparatus according to the suitable embodiment of the present invention.

As shown in FIG. 6, the engine 10 is used to drive a first and a second primary hydraulic pump 41' and 42' and a first and a second auxiliary hydraulic pump 43 and 44. The pressurized discharged fluids from the first and second primary hydraulic pimps 41' and 42' are supplied to a left hand side and a right hand side traveling motor 47 and 48 via a left hand side and a right hand side traveling valve 45 and 46, respectively, and both are supplied to a crusher hydraulic motor 24 via a crusher valve 49. The above mentioned left hand side and right hand side traveling valves 45 and 46 are capable of switching a pressurized pilot fluid from a pilot valve that is operated by the above mentioned pair of left hand side and right hand side traveling levers 14 and 14, whereas the above mentioned crusher valve 49 is switched by an operating lever 15.

A discharge path 43*a* from the above mentioned first auxiliary hydraulic pump 43 is controlledly connected to a first and a second circuit 51 and 52 via a feeder valve 50. The first and second circuits 51 and 52 are connected to a first and a second port 54*a* and 54*b* which are provided in a feeder hydraulic motor 54, via a counter-balance valve 53. The feeder valve 50 is normally held to take a neutral position A, is switched to take a first position B upon a first solenoid 55 being electrically energized and is switched to take a second position C upon a second solenoid 56 being electrically energized. The above mentioned first and second circuits 51 and 52 are provided with a first and a second pressure switch 57 and 58, respectively.

The above mentioned second auxiliary hydraulic pump 44 is connected to the conveyer purpose hydraulic motor 29 via a conveyer valve 64.

Figure 7:
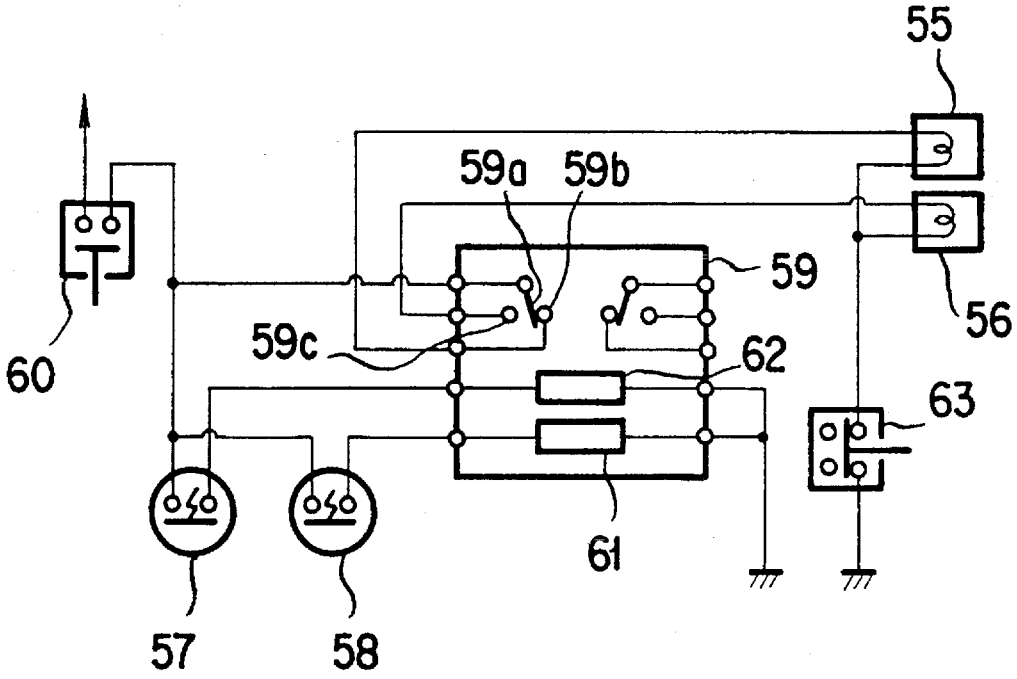
FIG. 7 is a circuit diagram illustrating a control circuit for controlling said hydraulic system that is adapted to drive said hopper bottom plate in said self-propelled crushing machine according to the suitable embodiment of the present invention.

As shown in FIG. 7, the above mentioned first and second solenoids 55 and 56 are connected to a power supply via a keep relay 59 and a main switch 60. The keep relay 59 is so constructed that when a reset coil 61 is electrically energized a contact 59*a* may be connected to a first terminal 59*b* and when a set coil 62 is electrically energized the contact 59*a* may be connected to a second terminal 59*c* and kept to continue that state.

The above mentioned first terminal 59*b* is connected to the first solenoid 55, the second terminal 59*c* is connected to the second solenoid 56, and the first and second solenoids 55 and 56 are connected to an emergency stop switch 63.

Next, an explanation will be given of the operation that is used to feed an object of crushing into the crusher 8.

When the main switch 60 is turned on, the first solenoid 55 will be electrically energized (i.e. an electric current will be passed therethrough) to bring the feeder valve 50 to its first position B. Then, a pressurized fluid will be supplied into the first port 54*a* of the feeder hydraulic motor 54 to drivingly rotate the latter in one direction, for example the positive direction.

The bottom plate 31 will thereby be reciprocated via the connecting rod 33 with a predetermined stroke amplitude to cast the object of crushing into the crusher 8.

In this state where the bottom plate 31 is reciprocated, if an object of crushing is clogged between the crusher 8 and the bottom plate 31 to bring about the locking of the latter, the discharge pressure of the first auxiliary pump 43 will be elevated to increase the pressure within the first circuit 51, thereby turning the first pressure switch 57 on.

When this occurs, the set coil 62 will be electrically energized to connect the contact 59*a* to the second terminal 59*c*, thereby electrically energizing the second coil 56. Since the feeder valve 50 is then switched to take its second position C to permit a pressurized fluid to be supplied into the second port 54*b* of the feeder hydraulic motor 54 to cause the latter to be drivingly rotated in the other (reversed) direction, the bottom plate 31 will be reversely moved to release the locking thereof. In a state before the bottom plate 31 is again positively moved, the main switch 60 will be turned off to electrically deenergize the second solenoid 56.

Unless the main switch 60 is turned off in the above mentioned state, the bottom plate 31 will again be positively moved to collide with the object of crushing and hence to be locked thereby. The pressure within the second circuit 52 will thus be elevated to turn the second switch on, thereby electrically energizing the reset coil 61 to connect the contact 59*a* to the first contact 59*b*. Therefore, the first coil 55 will be electrically energized to bring the feeder valve 50 to its first position B where the feeder hydraulic motor 54 will be rotated in the one (positive) direction, thereby reversely moving the bottom plate 31 again to release the locking thereof.

By repeating the foregoing operation, a voluminous object of crushing can be crushed without difficulty.

Since the hydraulic circuit for those hydraulic motors mentioned previously is so constructed as shown in FIG. 6, the following advantages are obtained.

Since for the reason that the traveling action and the crushing operation are not performed simultaneously, the left hand side and right hand side traveling hydraulic motors 47 and 48 and the crusher hydraulic motor 24 can be driven with the pressurized discharged fluids of the first and second primary hydraulic pumps 41' and 42' . Moreover, the feeder hydraulic motor 54 and the conveyer hydraulic motor 29 are supplied with the pressurized discharged fluids from the first and second auxillary hydraulic pumps 43 and 44, respectively. Therefore, the numbers of rotation of the respective hydraulic motors can be controlled independently of one another.

Especially, since the discharge path 43*a* of the first auxiliary hydraulic pump 43 is provided with a flow control valve 64, the supply flow rate into the feeder hydraulic motor 54 can be controlled as desired. Thus, by setting the difference in the number of rotation between it and the crusher hydraulic motor 24, the supply amount of the object of crushing can be matched with crushing functional ability.

When an object of crushing is clogged between a crusher 8 and a bottom plate 31 to cause a locking of the latter, a feeder hydraulic motor 54 will be reversely rotated to release the locking. Accordingly, it becomes unnecessary to crush a clogged object of crushing by using a hand breaker or the like, and the operation for releasing the locking is simplified. By reciprocating a feed plate 3, objects of conveyance charged in a hopper 2 can be supplied or fed, by dropping, just in an amount which is commensurate with the stroke amplitude of the reciprocation, and the objects of conveyance in the hopper 2 can be supplied or fed in each cycle by such a predetermined amount. Since the feed plate 3 is reciprocated by using a hydraulic motor 5, any excessive load of the hydraulic motor 5 can be prevented with a relief valve that is provided in a circuit for connecting the hydraulic motor 5 to a hydraulic pump. Furthermore, if the objects of conveyance are clogged at their outlet side, any immobilization of the feed plate 3 may not produce any unreasonable force.

While the present invention has hereinbefore been described with respect to certain illustrative embodiments thereof, it will readily be appreciated by a person skilled in the art to be obvious that many alterations thereof, omissions therefrom and additions thereto can be made without departing from the essence and the scope of the present invention. Accordingly, it should be understood that the present invention is not limited to the specific embodiments thereof set out above, but includes all possible embodiments thereof that can be made within the scope with respect to the features specifically set forth in the appended claims and encompasses all equivalents thereof.

What is claimed is:

1. A self-propelled crushing machine, comprising:

a vehicular chassis having a pair of left hand side and right hand side traveling bodies for moving or propelling the crushing machine;

a crusher mounted on the vehicular chassis, the crusher having a charge inlet;

a hopper mounted on a vehicular chassis;

a discharge conveyer arranged between the left hand side and right hand side traveling bodies of the vehicular chassis;

a bottom plate arranged in said hopper and adapted to be displaced towards the charge inlet of said crusher;

a rotary disk mounted on said vehicular chassis and arranged to be rotationally driven;

a connecting rod coupled between said bottom plate and said rotary disk for connecting said bottom plate and said rotary disk to each other so as to cause said bottom plate to be reciprocated by a rotation of said rotary disk;

a feeder hydraulic motor mounted on said vehicular chassis for rotating said rotary disk, said feeder hydraulic motor having a first port and a second port; and a hydraulic pump mounted on said vehicular chassis for supplying a fluid discharged therefrom into said first port and into said second port via a feeder valve mounted on said vehicular chassis, said feeder valve having a first position for supplying a pressurized fluid from said hydraulic pump into said first port and a second position for supplying the pressurized fluid into said second port, and said feeder valve being arranged so as to be switched from said first position to said second position and vice versa when a pressure of said first port and a pressure of said second port each exceeds a predetermined pressure, respectively.

2. A self-propelled crushing machine as set forth in claim 19, further comprising:

a first solenoid associated with said feeder valve and adapted to be supplied with an electric current for controlling said feeder valve so as to cause said feeder valve to take said first position;

a second solenoid associated with said feeder valve and adapted to be supplied with an electric current for controlling said feeder valve so as to cause said feeder valve to take said second position;

a keep relay coupled to said solenoids for passing an electric current through said first solenoid and through said second solenoid; and first and second pressure switches associated with said first and second ports, said first and second pressure switches being adapted to be turned on when said predetermined pressures are exceeded by the pressure of said first port and the pressure of said second port, respectively, said first and second pressure switches and said keep relay being so connected that when either of said first and second pressure switches is turned on, an electric current is passed through either of said first and second solenoids, respectively.

3. A self-propelled crushing machine as set forth in claim 1, in which said rotary disk and said connecting rod are connected to each other at a radially variable position of said rotary disk to enable said bottom plate to be reciprocated with a variable stroke amplitude of reciprocation.

4. A self-propelled crushing machine as set forth in claim 1, in which said bottom plate of the hopper is provided, at a rear end portion thereof, with a projection portion so formed as to project from an upper surface of said bottom plate in a direction of feeding of objects of crushing.

5. A self-propelled crushing machine, comprising:

a vehicular chassis provided with a traveling apparatus and which is adapted to be self-propelled;

a crusher mounted on said vehicular chassis for crushing objects of crushing;

a hopper disposed on said vehicular chassis above said crusher for charging the objects of crushing into said crusher;

a charge inlet means interposed between said crusher and said hopper on said vehicular chassis and adapted to be reciprocated for passing the objects of crushing between said hopper and said crusher and charging the objects of crushing from said hopper successively into said crusher;

a drive device mounted on said vehicular chassis for drivingly reciprocating said charge inlet means; and a drive control device operatively mounted on said vehicular chassis and responsive to a locking state of said charge inlet means during the reciprocation of said charge inlet means for automatically switching said drive device from a mode for charging the objects of crushing to a mode for releasing said locking state of said charge inlet means.

6. A self-propelled crushing machine as set forth in claim 5, in which said drive control device in the mode for releasing said locking state is responsive to a release of said locking state for automatically restoring the drive device to said mode for charging the objects of crushing from said mode for releasing the locking state.

7. A self-propelled crushing machine as set forth in claim 6, in which said drive device comprises a hydraulic motor provided with a first and a second fluid supply port and adapted to be driven in a normal direction of rotation upon said first fluid supply port being supplied with a pressurized fluid from a source thereof to operate in said mode for charging the objects of crushing, said hydraulic motor being adapted also to be driven in a reverse direction of rotation upon said second fluid supply port being supplied with the pressurized fluid from said source thereof to operate in said mode for releasing said locking state.

8. A self-propelled crushing machine as set forth in claim 7, in which said drive control device comprises a pressure detector which is arranged in a fluid supply passage between a source of the pressurized fluid and said first fluid supply port so that when a fluid pressure detected by said pressure detector exceeds a predetermined pressure a switching in fluid supply is effected from said first fluid supply port to said second fluid supply port to switch the operating mode of said drive device from said mode for charging the objects of crushing to said mode for releasing said locking state.

9. A self-propelled crushing machine as set forth in claim 7, in which said charge inlet means includes a movable bottom plate, and said drive device comprises a link mechanism for transforming a rotary driving force of said hydraulic motor to a linear movement force that is transmitted to said movable bottom plate so as to reciprocate said movable bottom plate.

10. A self-propelled crushing machine as set forth in claim 9, in which said link mechanism comprises a rotary member adapted to be rotationally driven by said hydraulic motor and a link member having a first end portion thereof connected to a position offset by a predetermined distance from a center of rotation of said rotary member and a second end portion thereof connected to one end portion of said bottom plate in a direction of reciprocation of said bottom plate.

11. A self-propelled crushing machine as set forth in claim 10, in which said link member is arranged such that an offset in an amount of a point of connection between said link member and said rotary member relative to said center of rotation is variable for making the reciprocation of said bottom plate variable with respect to a stroke amplitude thereof.

12. A self-propelled crushing machine as set forth in claim 5, in which said charge inlet means includes a movable bottom plate, and said movable bottom plate comprises a stepped projection portion at a rear end thereof in a direction in which the objects of crushing are conveyed.

13. A self-propelled crushing machine as set forth in claim 5, further comprising a discharge conveyer which is adjustable to be raised up and lowered down.

14. A self-propelled crushing machine in which a manipulating seat, a hopper, a crusher connected to the hopper and a power supply therefor are all mounted on a vehicular chassis provided with a traveling apparatus, wherein:

said crusher is disposed at an intermediary position between a front end and a rear end of said vehicular chassis;

said hopper and said power supply are disposed at a front end and at a rear end of said crusher, respectively, said hopper being arranged to feed objects of crushing to said crusher;

said power supply comprises a motor for operating said crusher;

said manipulating seat and said motor being disposed at a first side and at a second side of said crusher on said vehicular chassis, respectively;

said hopper has a movable bottom plate adapted to be displaced towards a charge inlet of said crusher;

the crushing machine further comprising:

a rotary disk operative mounted on said vehicular chassis and adapted to be rotationally driven;

a connecting rod connecting said bottom plate of the hopper and said rotary disk to each other so that a rotation of said rotary disk causes a reciprocation of said bottom plate relative to said vehicular chassis; and a feeder hydraulic motor mounted on said vehicular chassis for rotating said rotary disk:

said feeder hydraulic motor having a first port and a second port each adapted to be supplied with a discharge fluid via a feeder valve from a hydraulic pump, said feeder valve having a first position for supplying a pressurized fluid into said first port and a second position for supplying a pressurized fluid into said second port, and said feeder valve being adapted to be switched from said first position to said second position and vice versa when a pressure of said first port and a pressure of said second port each exceeds a set pressure, respectively.

15. A self-propelled crushing machine as set forth in claim 14, in which said feeder valve is adapted to take said first position upon a first solenoid thereof being supplied with an electric current and to take said second position upon a second solenoid thereof being supplied with an electric current;

the crushing machine further comprising:

a keep relay operatively mounted on said vehicular chassis for passing an electric current through said first solenoid and through said second solenoid; and a first pressure switch and a second pressure switch operatively mounted on said vehicular chassis and adapted to be turned on when said set pressure is exceeded by the pressure of said first port and the pressure of said second port, respectively, said first pressure switch and said second pressure switch as well as said first solenoid and said second solenoid through which an electric current can be passed by said relay when said first pressure switch and said second pressure switch are turned on, respectively, being so connected as to be reversed.

16. A self-propelled crushing machine as set forth in claim 15, in which said rotary disk and said connecting rod are connected to each other at a radially variable position of said rotary disk to enable said bottom plate to be reciprocated with a variable stroke amplitude of reciprocation.

17. A self-propelled crushing machine as set forth in claim 15, in which said traveling apparatus comprises a pair of left hand side and right hand side traveling mechanisms;

the crushing machine further comprising:

a discharge conveyer arranged between said left hand side and right hand side traveling mechanisms, said discharge conveyer having a portion thereof projected out of said vehicular chassis and said traveling apparatus from a side opposite to that side at which said motor is disposed.

18. A self-propelled crushing machine as set forth in claim 17, in which said discharge conveyer is arranged to be raised up and lowered down.

* * * * *